US005791261A

United States Patent [19]

John et al.

[11] Patent Number: 5,791,261

[45] Date of Patent: Aug. 11, 1998

[54] MODULAR PALLET SYSTEM

[75] Inventors: Michael John, Boca Raton; Robert V. Daigle, Deerfield Beach, both of Fla.

[73] Assignee: Plastic Pallet Production, Inc., Dallas, Tex.

[21] Appl. No.: 735,802

[22] Filed: Oct. 21, 1996

Related U.S. Application Data

[63] Continuation-in-part of Ser. No. 523,639, Sep. 5, 1995, and Ser. No. 562,507, Nov. 24, 1995.

[51] Int. Cl.[6] ..... B65D 19/32

[52] U.S. Cl. ..... 108/56.3; 108/902; 108/57.33

[58] Field of Search ..... 108/56.1, 56.3, 108/51.11, 902, 901, 57.25, 57.26, 57.27, 57.31, 57.33

[56] References Cited

U.S. PATENT DOCUMENTS

| | | | |
|---|---|---|---|
| 3,857,342 | 12/1974 | Johns | 108/56.1 X |
| 4,316,419 | 2/1982 | Cupido | 108/56.1 |
| 4,597,338 | 7/1986 | Kreeger | 108/902 X |
| 4,604,014 | 8/1986 | Frano | 108/56.3 X |
| 5,197,395 | 3/1993 | Pigott et al. | 108/56.1 |
| 5,388,533 | 2/1995 | Pigott et al. | 108/56.3 |
| 5,483,899 | 1/1996 | Christie | 108/56.3 |
| 5,492,069 | 2/1996 | Alexander et al. | 108/56.3 |

*Primary Examiner*—Peter M. Cuomo
*Assistant Examiner*—Janet M. Wilkens

[57] ABSTRACT

A modular pallet system definable in terms of xyz Cartesian coordinates includes a base structure in a lower xy plane having a x- and y-linear axis members internestable with each other at regions of orthogonal intersection to form a rectilinear matrix, each region of intersection of each linear member including an aperture of like geometry to each other aperture. The pallet system further includes a lower snap-lock elements, equal in number to that of the regions of orthogonal intersection, the snap elements proportioned for complemental securement within each of the apertures within each of the regions of orthogonal intersection of the x- and y-axis members with each other, each of the lower snap-lock elements including integrally projecting positive z-axis locking prongs. The system also includes a plurality of z-axis separators, equal in number to that of the regions of intersection within the lower xy plane, each of the separators proportioned, in all xy planes, for enclosure of the z-axis locking prongs of the lower snap-lock elements, the separators further including four integral z-axis sides, and open xy planes at upper and lower faces. The separators operate to define a rigid z-axis dimension of the pallet system.

9 Claims, 9 Drawing Sheets

MODULAR PALLET SYSTEM

REFERENCE TO RELATED APPLICATION

This case is a continuation-in-part of application Ser. Nos. 08/539,639 and 08/562,507, filed Sep. 5, 1995 and Nov. 24, 1995, respectively.

BACKGROUND OF THE INVENTION

Pallets are flat, typically two-layered rigid articles employed in the transportation and storage of a vast variety of consumer and industrial products and materials. Pallets are typically attached to cartons or packaging of the product or supply of interest at the site of production or origination of a partially or fully manufactured product. The pallet assures that the product will be shipped and stored in a physical relationship to the pallet that is generally defined by the manufacturer thereof. Further, movement of products and materials associated with a given pallet can be effected through the use of the prongs of a forklift vehicle or pallet jack to facilitate the movement on and off of transportation vehicle means and for repositioning of pallets and their associated materials within warehouses. Accordingly, it is to be appreciated that pallets have, in the present industrial period, become the predominant manner in which a majority of the industrial output of the world is transported from a point of manufacture, onto transportation means, and finally into and within warehousing facilities, and therefrom to the end user or retailing establishment.

The norm in pallet construction has been that of wood planks and beams, connected by nails or screws. The problems of such prior art pallets have been many, these including without limitation that:

1. The weight of a commercial wooden pallet is excessive, thereby giving rise to problems of cost and risk of injury.
2. Wooden pallets cannot be modularized.
3. Projecting nails, and screws and splinters present a safety problem.
4. The life of wood in typical pallet use is quite limited.
5. Damaged wooden pallets are difficult to repair.
6. Wooden pallets are not easily disposed of.
7. Such pallets cannot be readily recycled, this due primarily to the presence of nails and screws embedded within the wood structure thereof.
8. Due to susceptibility of wood to infestation, many countries require costly fumigation of all wood pallet-containing imports.

Notwithstanding the relatively nominal cost (about $4.00 to $40.00) of various wooden pallets, the above problems have given rise to a need in the art for a modular pallet, that is, one in which the parts thereof may be readily replaced when damaged, for a pallet having a considerable longer life and resistance to hostile environments than the traditional wood pallet, and for one that can be completely recycled in response to environmental concerns.

The prior art, as known to the inventors, is best represented by U.S. Pat. No. 5,197,395 (1993) to Pigott and U.S. Pat. No. 5,483,899 (1996) to Christie.

Pigott does not provide a pallet that can be effectively lifted by a pallet jack which is considered a necessity for a viable pallet. Further its configuration makes for hygienical problems as it is very difficult to clean. Trapped foreign matter makes it no better than a wood pallet. Further, the top and bottom surfaces of Pigott comprise a unitary, not a modular, structure, as in the instant system, subject to load and, therefore, to potential degradation. Further, the internal locking means of Pigott are, unlike the present system, subject to load and therefore to potential degradation.

In Christie, the internal locking means are integral with the vertical-dimension-defining means of the system. This structure suffers from many functional deficiencies, and its construction requires a precision which is unobtainable with recycled materials. Again, hygienics are all but impossible with the closed compartments which trap foreign matter. Also, the structure of Christie cannot be lifted from all directions by a fork lift or pallet jack.

SUMMARY OF THE INVENTION

The present modular pallet system is definable in terms of xyz Cartesian coordinates. The system more particularly includes a base structure in a lower xy plane, said structure comprising a plurality of x- and y-linear axis members, said members internestable with each other at regions of orthogonal intersection therebetween to form a rectilinear matrix, each of said x-axis members identical to each other, each of said y-axis members identical to each other, and each region of intersection of each linear member including an aperture, of like geometry to each other aperture therein. The pallet system further includes a plurality of lower snap-lock elements, equal in number to that of said regions of orthogonal intersection, said lower elements proportioned for complemental securement within each of said apertures within each of said regions of orthogonal intersection of said x- and y-axis members with each other, each of said lower snap-lock elements including integrally projecting positive z-axis locking means. The system also includes a plurality of z-axis separation means, equal in number to that of said regions of intersection within said lower xy plane, each of said separation means proportioned, in all xy planes thereof, for enclosure of said z-axis locking means of said lower snap-lock elements, said separation means further including four integral z-axis sides, and open xy planes at upper and lower faces thereof, said separation means operating to define a rigid z-axis dimension of the pallet system. Also included in the system is a top structure in an upper xy plane, above said lower xy plane, said top structure including a plurality of apertures therein located at z-axis positions corresponding to each of said regions of orthogonal intersection of said x- and y-axis members of said base structure. There is provided a plurality of upper snap-lock elements, equal in number to that of said regions of orthogonal intersection, said upper snap-lock elements proportioned for complemental securement within each of said apertures of said top structure, each of said top snap-lock elements including integrally projecting negative zaxis locking means proportioned for complemental engagement with said positive z-axis locking means of said lower snap-lock elements. When said respective lower and upper snap-lock elements are secured within the respective apertures of said base and top structures, and said z-axis locking means of said respective snap-lock elements are secured to each other within said separation means, thereby defining a rigid three-dimensional rectilinear pallet system.

It is accordingly an object of the present invention to provide a modular pallet system having enhanced cost-effectiveness of usage relative to prior art non-modular and wooden pallets.

It is another object to provide a pallet system which may be readily repaired by replacing only damaged portions thereof. It is a further object of the invention to provide a pallet system having enhanced durability over prior art pallets.

It is a still further object to provide a pallet system that can be shipped in component parts and then assembled at a destination without need for tools or special hardware.

It is a still further object to provide a pallet within weight limitations imposed by insurance companies.

It is a still further object of the invention to provide a pallet system which, after its life cycle, may be completely recycled.

It is another object to provide a pallet system which will not pose safety problems associated with the use of sharp metal articles, such as bolts, screws, and rivets embedded within wooden and non-modular pallet structures.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
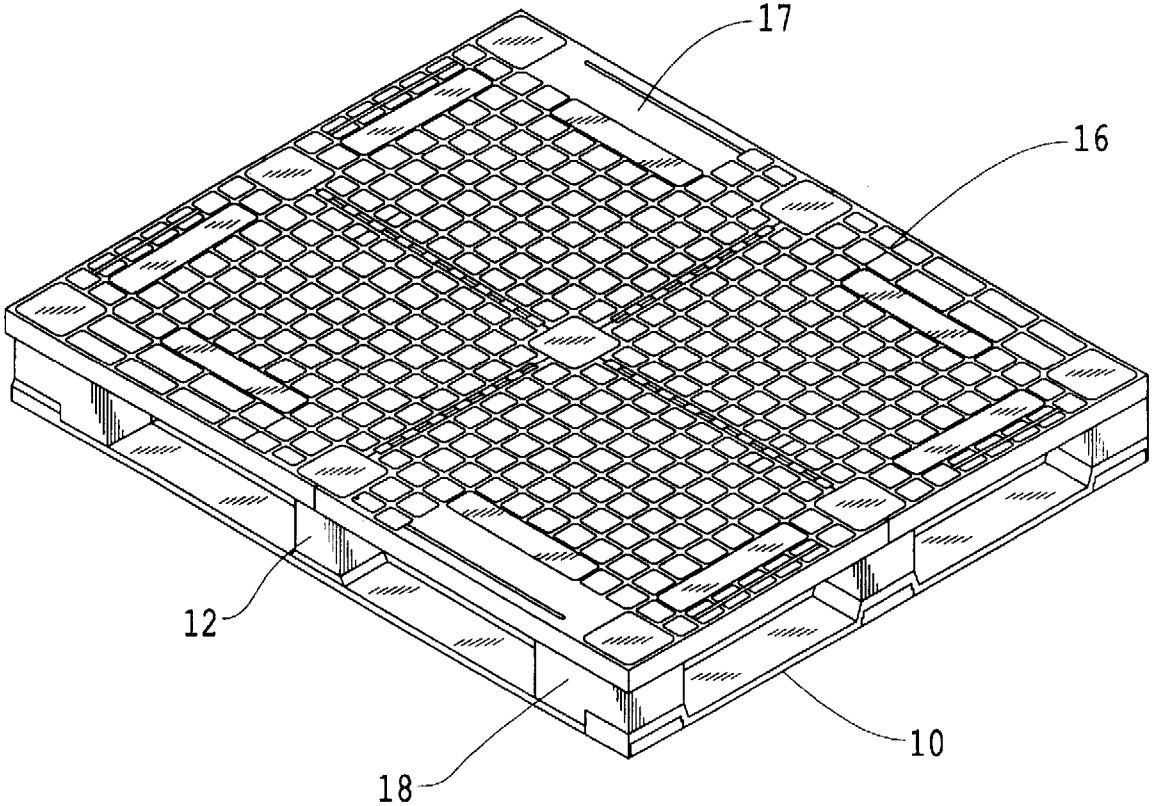
FIG. 1 is a perspective view of the inventive pallet system.

With reference to the perspective view of FIG. 1, the inventive modular pallet system may be seen to be definable in terms of xyz cartesian coordinates, in accordance with the protocol shown to the lower right of said FIG. 1. More particularly, the present pallet system includes a base structure 10 which exists in a lower xy plane, a plurality of z-axis separation means 12, and a top structure 16 which exists in an upper xy plane of the system. The top structure includes logo or graphic symbol surface 17.

As may be noted, the separation means 12 may be provided in a variety of geometries such as the geometry of second separation means 18 which is shown at the corners of the system in FIG. 1.

Figure 2:
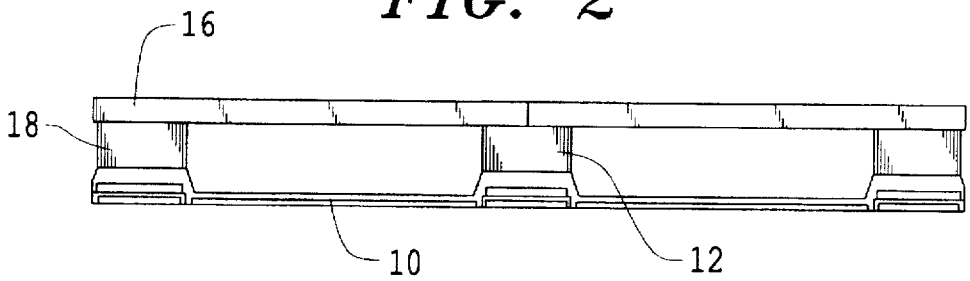
FIG. 2 is a side yz plane view thereof.
Figure 3:
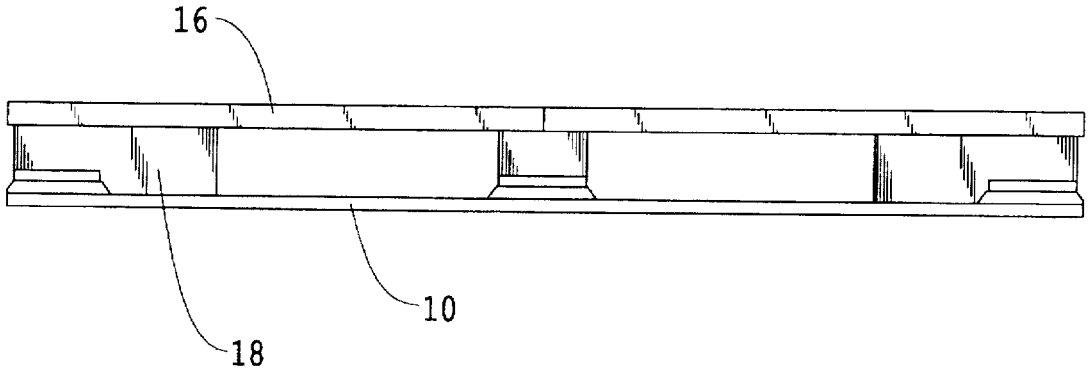
FIG. 3 is a side xz plane view thereof.

The system of FIG. 1 may be seen from the yz plane in the view of FIG. 2, and from the xz plane in the view of FIG. 3.

Figure 4:
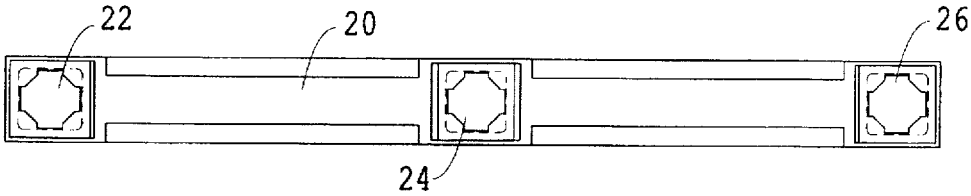
FIG. 4 is a top plan view of the x-axis member.
Figure 5:
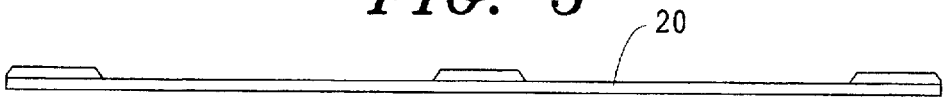
FIG. 5 is a side plan view thereof.
Figure 6:
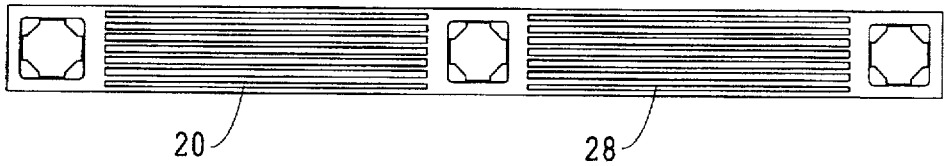
FIG. 6 in a bottom plan view thereof.
Figure 10:
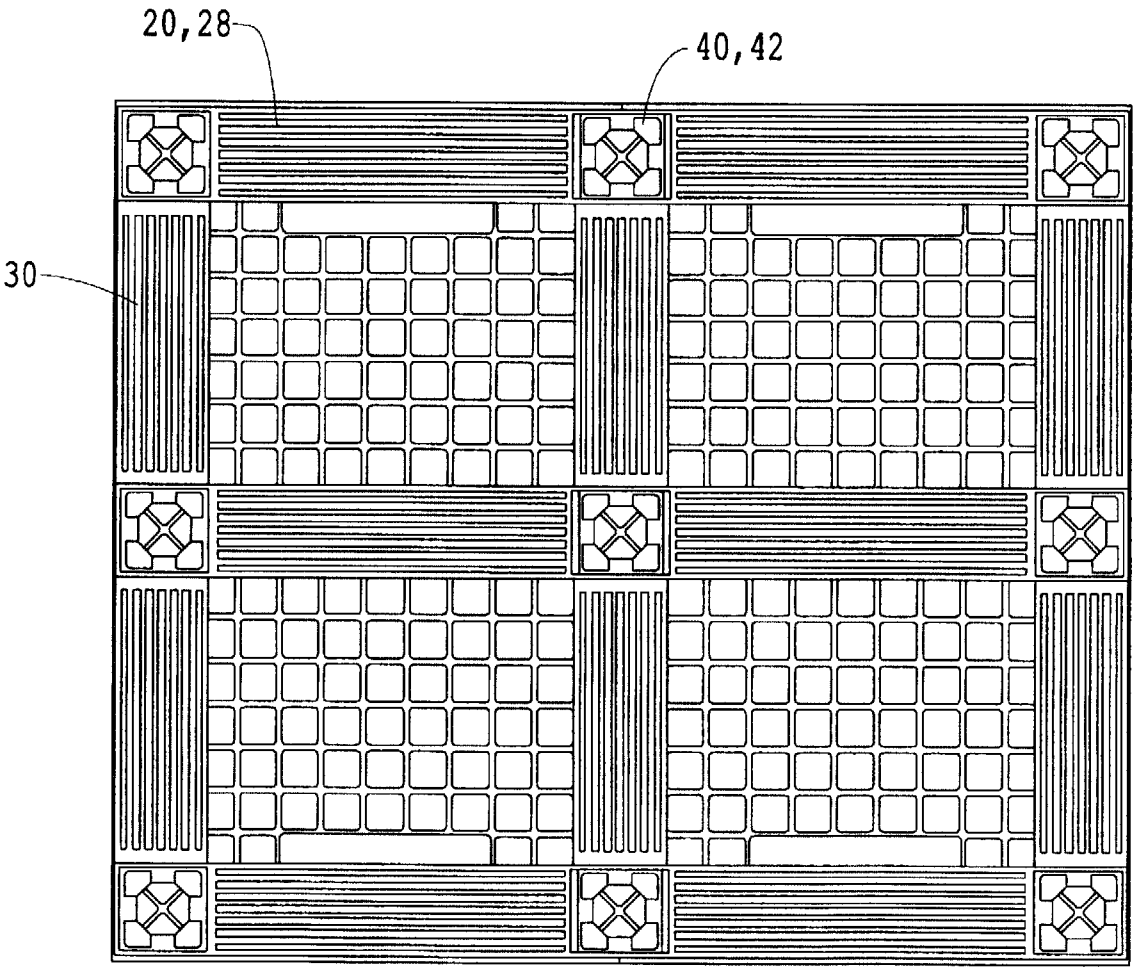
FIG. 10 is bottom view of the pallet system.

With more particular reference to the form of the base structure 10, there are, in the views of FIGS. 4, 5 and 6, shown top, side and bottom plan views of an x-axis linear member 20, three of which comprise a part of the base structure 10 of the system (see FIG. 10). As may be noted, each x-axis member is provided with xz plane apertures 22, 24 and 26, each having like geometry to each other. As may be further noted in the side view of FIG. 5, the region surrounding each aperture is elevated. As may be noted in the bottom view of FIG. 6, lower surface 28 of each x-axis member 20 is provided with a friction enhancing type of surface.

Figure 7:
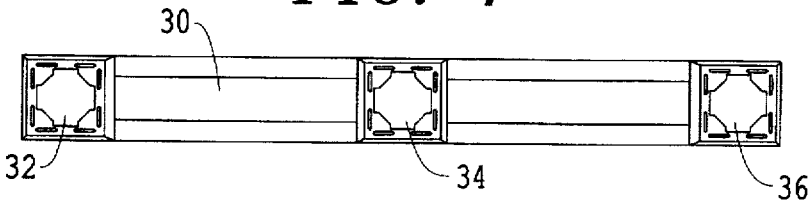
FIG. 7 is a top plan view of the y-axis member.
Figure 8:
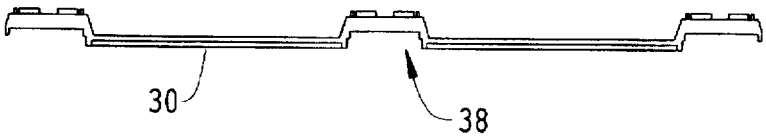
FIG. 8 is a side plan view thereof.
Figure 9:
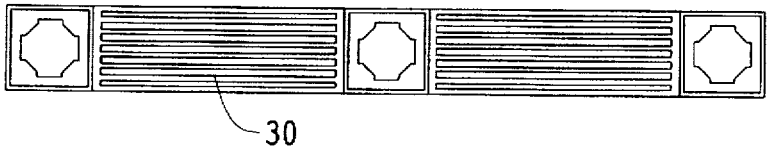
FIG. 9 is a bottom plan view thereof.

With reference to the views of FIGS. 7, 8 and 9, there is shown in top, side and bottom plan views respectively a y-axis member 30, three of which are used in the present modular pallet system. (See FIG. 10) As may be noted, each y-axis linear member is provided with apertures 32, 34 and 36 having a geometry identical to said apertures 22, 24 and 26 of the x-axis members 20. As may be noted in FIG. 10, the y-axis members 30 are positioned orthonormally to the x-axis members 20 and are internested therewith. Such internesting occurs when the x-axis member, which are the lowermost elements of the system, are placed underneath and within elevated areas 38 (see FIG. 8) of the y-axis linear members which, thereby, are placed over the x-axis members 20. The resulting structure of such internesting may be seen with reference to the bottom view of FIG. 10 in which may be more particularly seen regions of intersection 40 which are defined by the internesting of the apertures 32, 34 and 36 of the y-axis members 30 with the apertures 22, 24 and 26 of the x-axis members 20. It is to be understood that while the present embodiment shows a structure having three apertures along each of the x and y axis, within the scope of the present invention, systems having a smaller or larger number of regions of orthogonal intersection may be construed.

Figure 13:
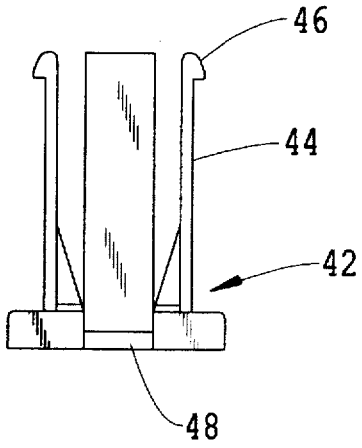
Figure 14:
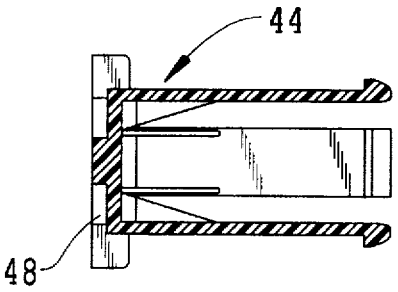

Following the internesting of the x and y axis linear members, a plurality of lower snap-lock elements 42 (see FIGS. 11 through 14) are provided which are equal in number to the number of regions of orthogonal intersection 40, discussed above. Said lower snap-lock elements 42 are proportioned for complemental securement within each of said apertures 24 and 34, said apertures 22 and 32, and said aperture 26 and 36, of the x and y axis linear members. As may be noted in the side view of FIG. 13 and the cross-sectional view of FIG. 14, each lower snap-lock element 42 is provided with a plurality of positive z-axis locking means 44 which are in the nature of prong-like means 46. Further, each of the positive z-axis locking means 44 project from an integral xy axis base 48.

Figure 11:
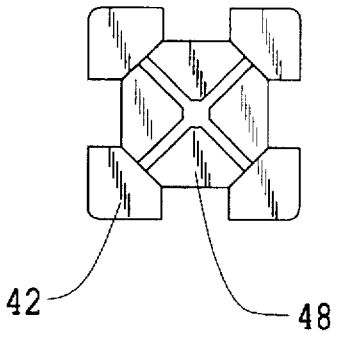
FIGS. 11 to 14 are bottom, top, side and axial cross-sectional views of the lower snap-lock element.
Figure 12:
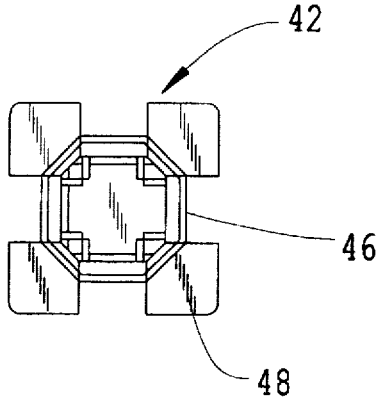

The bottom view of FIG. 11 and the top view of FIG. 12 show but one of the many xy plane geometries which the present lower snap-lock elements 42 may take.

Figure 15:
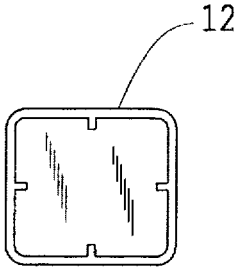
FIG. 15 is a top view of the first z-axis separation means.
Figure 16:
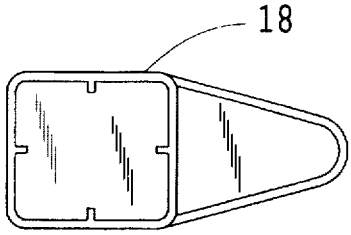
FIG. 16 is a top view of the second z-axis separation means.

The possible structure of the separation means 12 and 18 are shown with reference to the xy plane view of FIG. 15 and 16 respectively. Therein may be seen but two of the possible xy plane geometries of the z-axis separators that may be employed at the corners, the center, the x-axis non-centers and the y-axis non-centers of the present system. As may be appreciated, the larger (in the x-axis) separation means 18 will be more generally used at the corners of the structure to provide enhanced strength at such locations. It is to be further noted that separation means 12 and 18 provide the z-axis clearance between the base and top structures 10 and 16 necessary to accommodate the arms of a fork lift and pallet jack.

Figure 17:
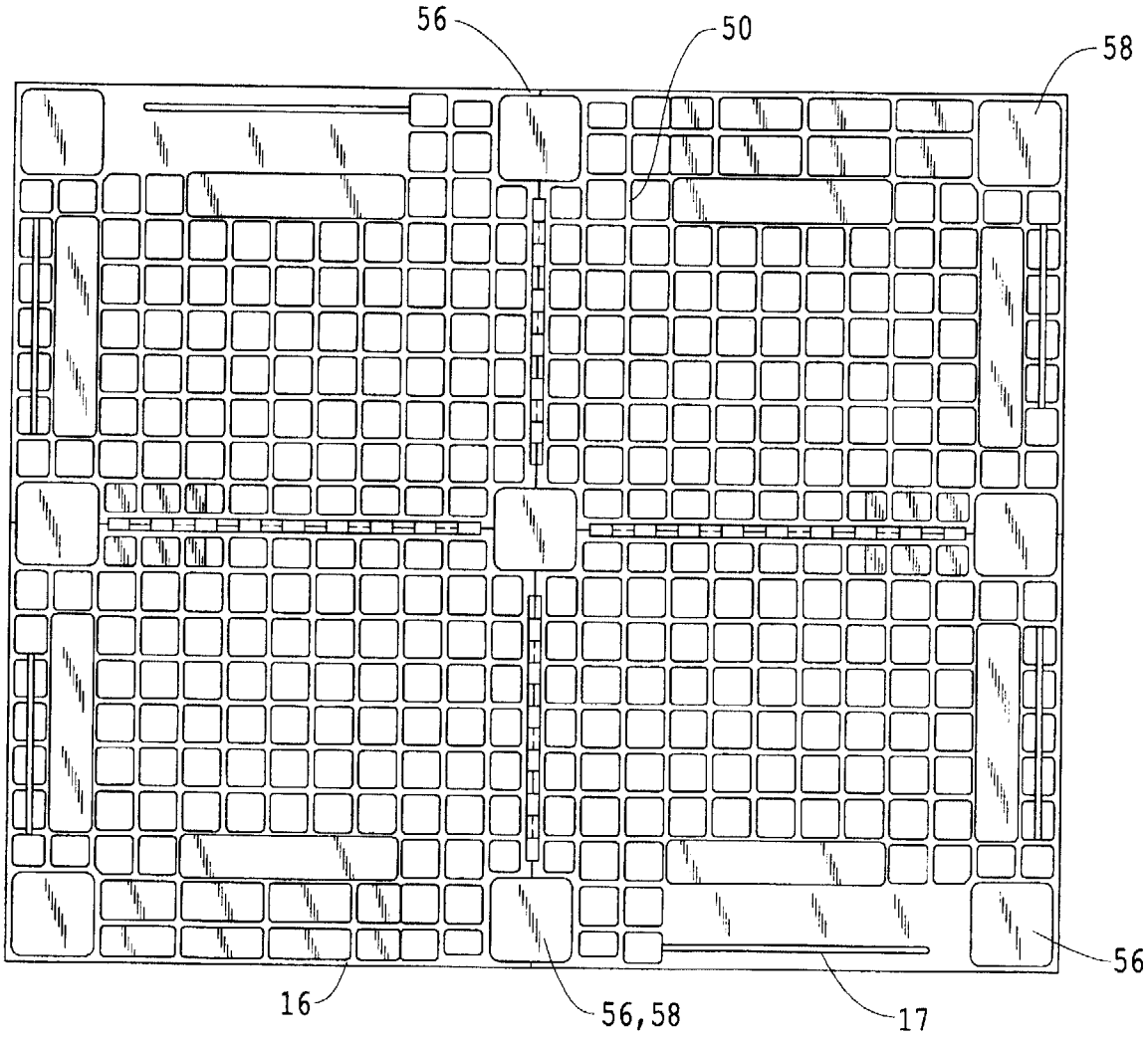
FIG. 17 is a top view of the pallet system.
Figure 18:
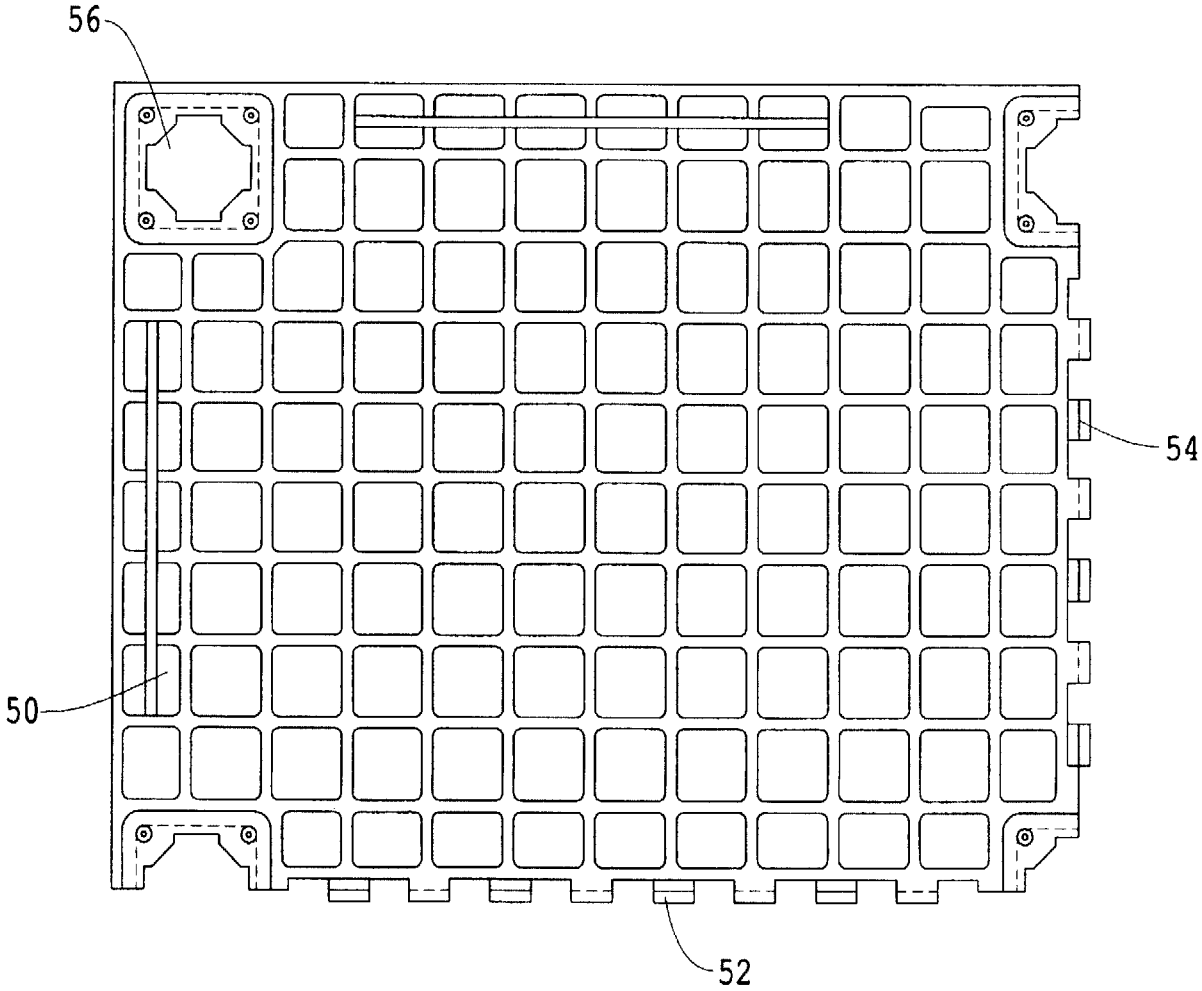
FIG. 18 is an enlarged view of one quadrant of the top structure of the system.
Figure 19:
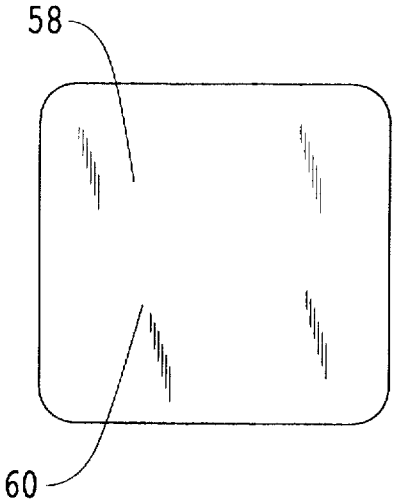
FIGS. 19–22 are top, bottom, side and axial cross-sectional views of the upper snaplock element.
Figure 20:
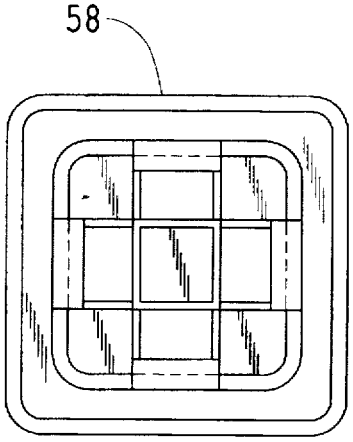
Figure 21:
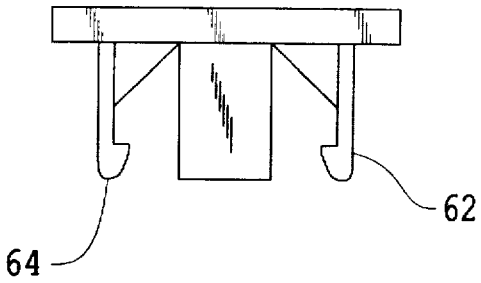
Figure 22:
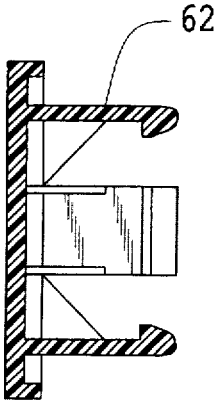

In FIG. 17 is shown the present modular pallet system in top plan view. Therein, as may be seen, top structure 16 may be formed of quadrants of honeycomb-like structure 50, one of which is particularly shown in FIG. 18. Each quadrant is provided with first interlock means 52 along the x-axis thereof and second interlock means 54 along the y-axis thereof. As may be appreciated, assembly of the top structure is affected by connecting the x-axis interlock means 52 to each other and then connecting the y-axis means 54 to each other. The resultant structure is one in which there exists a plurality of apertures 56 located at the same z-axis positions which corresponds to said regions of orthogonal intersection 40 of said x and y axis linear members of the base structure 10 of the system. Accordingly, apertures 56 of the top structure are aligned directly over the apertures 40 of the base structure. Within said apertures 56 are placed a plurality of upper snap-lock elements 58 (see FIGS. 17 and FIGS. 19 to 22) which are equal in number to that of the regions of orthogonal intersection and, thereby, are equal in number to the number of said lower snap-lock elements 42. Each of said upper snap-lock elements are proportioned for complemental securement within each of said apertures 56 of the top structure 16. As may be more particularly seen in the views of FIGS. 19 to 22, each of said upper snap-lock elements 58 include an integral xy plane base 60 and a plurality of negative z-axis locking means 62 having prong-like means 64 at the ends thereof. Locking means 62 and prong means 64 are proportioned for complemental engagement with the positive z-axis locking means 44 and associated prongs 56 of lower snap-lock elements 42.

Figure 23:
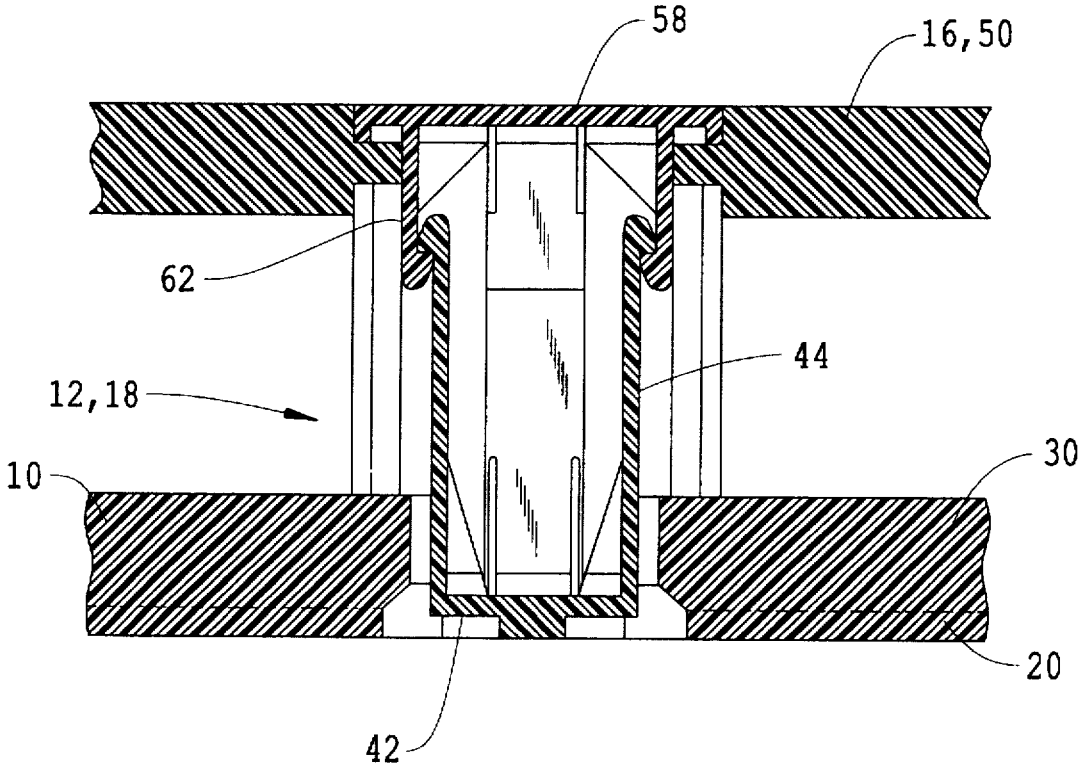
FIG. 23 is an assembly view of all parts of the system which occupy each region of orthogonal intersection of the system.

In the assembly detail view of FIG. 23, a view which is correct in both the xz and yz planes, may be seen the interlock between the upper and lower snap-lock elements 42 and 58 respectively and, as well, the inter-relationship between separation means 12 and 18, and base structure 10 (formed of the combination of x and y linear elements 20 and 30 respectively) and upper structure 16 and its constituent honeycomb quadrants 50. More particularly, the z-axis defining function of the separation means may be seen as that of enabling the three-dimensional rigid structure of the present modular pallet system.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described our invention what we claim as new, useful and non-obvious and, accordingly, secure by Letters Patent of the United States is:

1. A modular pallet system definable in terms of xyz Cartesian coordinates, the system comprising:

(a) a base structure in a lower xy plane, said structure comprising a plurality of x- and y-linear axis members, said members internestable with each other at regions of orthogonal intersection therebetween to form a rectilinear matrix, each of said x-axis members identical to each other, and each of said y-axis members identical to each other, and each region of intersection of each linear member including an aperture, of like geometry to each other aperture therein;

(b) a plurality of lower snap-lock elements, equal in number to that of said regions of orthogonal intersection, said lower elements proportioned for complemental securement within each of said apertures within each of said regions of orthogonal intersection of said x- and y-axis members with each other, each of said lower snap-lock elements including integrally projecting positive z-axis locking means;

(c) a plurality of z-axis separation means, equal in number to that of said regions of intersection within said lower xy plane, each of said separation means proportioned, in all xy planes thereof, for enclosure of said z-axis locking means of said lower snap-lock elements, said separation means further including four integral z-axis sides and open xy planes at upper and lower faces thereof, said separation means operating to define a rigid z-axis dimension of the pallet system;

(d) a top structure in an upper xy plane, above said lower xy plane, said top structure including a plurality of apertures therein located at z-axis positions corresponding to each of said region of orthogonal intersection of said x- and y-axis members of said base structure; and (e) a plurality of upper snap-lock elements, equal in number to that of said regions of orthogonal intersection, said upper snap-lock elements proportioned for complemental securement within each of said apertures of said top structure, each of said top snap-lock elements including integrally projecting negative z-axis locking means proportioned for complemental engages with said positive z-axis locking means of said lower snap-lock elements, whereby when said respective pluralities of snap-lock elements are secured within the respective apertures of said base and top structures, and said z-axis locking means of said respective snap-lock elements are secured to each other within said separation means, there is defined a rigid three-dimensional rectilinear pallet system.

2. The system as recited in claim 1, in which said top structure comprises:

four interlockable quadrants within said upper xy plane.

3. The system as recited in claim 2, in which each of said quadrants include honeycomb-like surfaces thereof.

4. The system as recited in claim 1, in which said locking means of each of said upper and lower snap-like elements comprises:

mutually complementally prong-like means.

5. The system as recited in claim 4, in which each of said upper and lower snap-lock elements include:

an xy surface from which said z-axis snap-lock means depend.

6. The system as recited in claim 5 in which said lower and upper xy planes of the pallet system define a dimension therebetween sufficient to permit insertion of arms of a fork lift vehicle and a pallet jack from any side thereof.

7. The system as recited in claim 6, in which said separation means comprise:

various geometries in xy planes thereof at selectable regions of intersection of said top and base structures of the pallet system.

8. The system as recited in claim 6, further comprising:

anti-skid means affixed to selectable areas of said xy plane of said top structure of the pallet system.

9. The system as recited in claim 4, in which said regions of intersection of said base structure comprise:

at least four corners, a center, two x-axis non-centers, and two y-axis non-centers of said base structure.

* * * * *